US005624039A

United States Patent [19]

Folsberg

[11] Patent Number: 5,624,039

[45] Date of Patent: Apr. 29, 1997

[54] SEPARATOR FOR SORTING OF PARTICULAR MATERIAL

[75] Inventor: Jan Folsberg, Copenhagen, Denmark

[73] Assignee: F. L. Smidth & Co. A/S, Denmark

[21] Appl. No.: 500,963

[22] PCT Filed: Apr. 7, 1994

[86] PCT No.: PCT/EP94/01069

§ 371 Date: Jul. 24, 1995

§ 102(e) Date: Jul. 24, 1995

[87] PCT Pub. No.: WO94/25185

PCT Pub. Date: Nov. 10, 1994

[30] Foreign Application Priority Data

Apr. 27, 1993 [DK] Denmark ..... 478/93

[51] Int. Cl.[6] ..... B04B 5/12

[52] U.S. Cl. ..... 209/714

[58] Field of Search ..... 209/714, 713, 209/143

[56] References Cited

U.S. PATENT DOCUMENTS 4,689,141 8/1987 Folsberg ..... 209/714

FOREIGN PATENT DOCUMENTS 0204412 12/1986 European Pat. Off. .
1218264 6/1966 Germany .
363879 9/1962 Switzerland .

*Primary Examiner*—David H. Bollinger
*Attorney, Agent, or Firm*—Brumbaugh, Graves, Donohue & Raymond

[57] ABSTRACT

A separator for sorting of particulate material suspended in a conveying gas into a fine fraction and a coarse fraction, which separator comprises a rotor with a shaft, a housing, which encases the rotor and has an inlet for the material/gas suspension and outlets for fine and coarse fractions, respectively. Regulating means are associated with the shaft for adjusting the axial position of the shaft, and hence of the rotor, relative to the housing, thereby adjusting the amount of unseparated material that bypasses the rotor and passes directly to the fine fraction outlet.

2 Claims, 1 Drawing Sheet

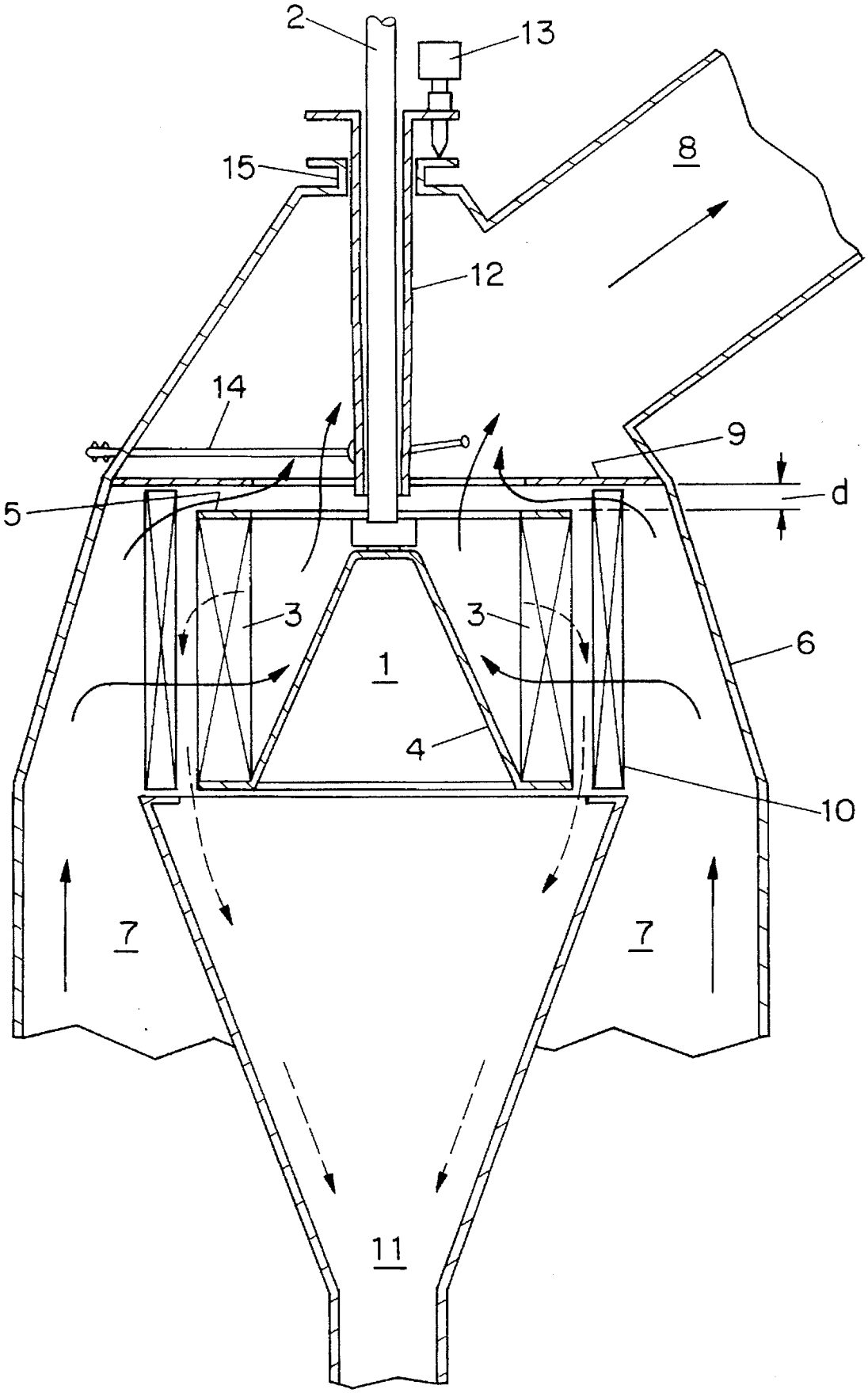
2
13
15
8
12
14
9
d
5
3
3
6
1
4
10
7
7
11

SEPARATOR FOR SORTING OF PARTICULAR MATERIAL

The present invention relates to a separator for sorting particulate material suspended in a conveying gas into a fine fraction and a coarse fraction. The separator comprises a rotor with a substantially vertical shaft, a housing encasing the rotor, and having an inlet for a material/gas suspension and outlets for fine and coarse fractions, respectively.

It is a recognized fact that the gap between the top of the separator rotor and the top of the separator housing or a stationary top plate above the rotor is of crucial importance for the attainable steepness of the particle size distribution (PSD) curve of the finished material (percentage sieve residue of a weighed sample as a function of particle diameter). The underlying explanation is that the greater or smaller gap is the main determinant of the size of the material quantities which can be conveyed past the rotor and directly into the fine material.

For cement grinding, it was previously very important, particularly for separators deployed in tube mill circuits, to ensure minimization of the gap in order to achieve the steepest possible particle size distribution curve.

By contrast, the principal objective in connection with finish grinding of cement in vertical mills and roller presses is to obtain a less steep PSD curve than can normally be achieved in these mills, given that very steep finished material PSD curves for cement, which means that the cement consists of a narrow, i.e. uniform, particle fraction, will require more water when the mortar and concrete, of which the cement is a constituent ingredient, is to be brought to a state of normal consistency.

A numbers of methods have previously been proposed for changing the PSD curve for finished material so that it comprises a more varied particle size distribution. It is thus known practice from the Danish patent specification No. 161810 to provide a separator with several different sets of rotor blades with different sorting parameters and incorporating control means for regulating the relative gas streams passing through the different sets of rotor blades. As a result, it is possible to influence the particle size distribution of the finish-separated product. One method suggested for regulating the gas flow rate involves the use of an axially displaceable elongation of the outlet duct whereby the gap width between the rotor top and the outlet duct (FIG. 3) is regulated. However, it is rather difficult to achieve precise control during operation with this separator since the diameter of the outlet channel is often about 2.5 metres or more and since the vertical adjustment is approximately 20–50 mm. This would make it necessary to regulate the vertical position of the elongation of such an outlet duct at, as a minimum, three points on the circumference of the duct.

It is the object of the present invention to increase the possibilities of controlling the amount of gas suspension which is directed past the rotor, thereby regulating the PSD curve for the finished material, while simultaneously eliminating the aforementioned disadvantages associated with the prior art.

According to the invention this is achieved with the aid of a regulating means for adjusting the axial position of the rotor shaft, and hence of the rotor, relative to the housing. As a result, the distance between the rotor and the top of the casing or a top plate between the inlet area of the rotor and the outlet area for the fine fraction can be adjusted. The vertical adjustment of the rotor is performed in a relatively simple manner, owing to the relatively small dimensions of the shaft and its bearing housing.

BRIEF DESCRIPTION OF THE DRAWING

The invention will now be described in further detail by means of an example of a separator constructed in accordance with the invention and illustrated in the accompanying drawing, which is diagrammatical, and shows an axial sectional view through the separator.

DETAILED DESCRIPTION OF THE INVENTION

The separator illustrated on the drawing has a rotor 1 which is rotatable about a vertical axis and driven by means of a motor (not shown) and gear unit via a shaft 2. The rotor is provided with blades 3 which are partly fixed to a circular bottom plate 4 and partly to an annular top plate 5.

The rotor is surrounded by a housing 6, the lower part of which constitutes an inlet duct 7 for feeding of unsorted material to the rotor. At the top of the housing 6 there is an outlet duct 8 for diverting a fine fraction of the material which has been separated in the rotor. The boundary between the top of the inlet duct 7 and the outlet duct 8 is composed of an annular plate 9 which forms a part of the housing 6, with the fine fraction passing through this plate. It is possible to vary the distance d between the annular plate 9 and the top of the rotor blades 3. Stationary guide vanes 10 are fitted around the circumference of the rotor 1, and there is an outlet 11 under the guide vanes 10 and the rotor 1 for a coarse fraction of the material which has been separated in the rotor.

The shaft 2 is carried via a thrust bearing in a bearing housing 12 which is mounted relatively to the housing 6 as a sliding fit 15. The lower part of the bearing housing 12 is resiliently supported, e.g. by means of spring-loaded tie bars 14 which will ensure that the horizontal orientation of the bearing housing is maintained irrespective of the vertical displacement, and, consequently, only the upper position of the bearing housing 12 needs to be adjusted. Outside the housing 6 a regulating means 13 is installed, e.g. a spindle motor or a hydraulically operated piston ring, by means of which it is possible to vary the displacement of the bearing housing 12 relative to the housing 6.

In this context, it will also be possible to maintain the bearing housing in a fixed position so that only the position of the shaft is varied.

Material to be sorted in the separator is suspended in a conveying gas, and fed to the rotor 1 through the inlet duct 7, which consists of the lower part of the housing 6. The majority of the conveying gas and the suspended material flows into the rotor 1, and initially pass through the stationary guide vanes 10 and then the rotor blades 3. The fine fraction is then carried with the conveying gas through the central opening in the plate 9 which constitutes the upper boundary of the inlet duct 7 and discharged through the outlet duct 8.

The remaining part of the conveying gas and the suspended material continues its direct upward flow and passes between the plate 9 and the top of the rotor blades 3 and moves onward towards the centre of the rotor 1 where the unsorted material is mixed with the fine fraction and carried out through the outlet duct 8.

During the passage of the rotating blades 3, heavier particles are flung outwards by the action of the centrifugal forces which are generated by means of the rotor 1. The heavy particles strike against the stationary guide vanes 10 and fall down along the vanes towards the outlet duct 11 from which it is recirculated for additional treatment, e.g. on a grinding table with grinding rollers under the separator.

Since the vertical distance between the vertical late 9 and the rotor 1 can be varied, it is possible to control the amount of gas which is directed past the rotor, and hence the proportion of coarser particles which is passed to the fine fraction, thereby attaining the desired particle size distribution for the finished product which leaves the separator via the outlet duct 8.

I claim:

1. A separator for sorting particulate material suspended in a conveying gas into a fine fraction and a coarse fraction, which separator comprises a rotor with a shaft; a housing encasing the rotor and having an inlet for material/gas suspension entering the housing radially outside the rotor, an outlet for a fine fraction leading from radially within the rotor and an outlet for a coarse fraction leading from radially outside the rotor; whereby a major part of the material/gas suspension passes radially inwardly into the rotor while the remaining minor part of the suspension flows directly to the fine fraction outlet duct bypassing the rotor; said housing being separated from the top of the rotor by a distance that is variable depending upon the axial position of the rotor relative to the housing, and wherein an increase in said distance from the housing to the top of the rotor causes an increased amount of said remaining minor part of the suspension to bypass the rotor and flow directly to the fine fraction outlet duct, said separator further comprising a regulating means for adjusting the axial position of the shaft, and hence of the rotor relative to the housing in order to adjust the amount of unseparated material bypassing the rotor to the fine fraction outlet.

2. A separator according to claim 1, wherein the shaft (2) is carried at its upper end in a bearing housing (12), which can be displaced vertically by the regulating means (13).

* * * * *